US005388668A

United States Patent [19]

Powell et al.

[11] Patent Number: 5,388,668

[45] Date of Patent: Feb. 14, 1995

[54] ELEVATOR DISPATCHING WITH MULTIPLE TERM OBJECTIVE FUNCTION AND INSTANTANEOUS ELEVATOR ASSIGNMENT

[75] Inventors: Bruce A. Powell, Canton; John N. Williams, Coventry, both of Conn.

[73] Assignee: Otis Elevator Company, Farmington, Conn.

[21] Appl. No.: 59,152

[22] Filed: Aug. 16, 1993

[51] Int. Cl.[6] ..... B66B 1/18

[52] U.S. Cl. ..... 187/387; 187/380

[58] Field of Search ..... 187/121, 125, 124, 126, 187/127, 128

[56] References Cited

U.S. PATENT DOCUMENTS

| | | | |
|---|---|---|---|
| 4,043,429 | 8/1977 | Hirasawa et al. | 187/29 R |
| 4,082,162 | 4/1978 | Sackin et al. | 187/29 R |
| 4,244,450 | 1/1981 | Umeda et al. | 187/29 R |
| 4,363,381 | 12/1982 | Bittar | 187/29 |
| 4,520,905 | 6/1985 | Sasao | 187/124 |
| 4,760,896 | 8/1988 | Yamaguchi | 187/124 |
| 4,782,921 | 11/1988 | MacDonald et al. | 187/127 |
| 4,790,412 | 12/1988 | MacDonald et al. | 187/127 |
| 4,793,443 | 12/1988 | MacDonald et al. | 187/127 |
| 4,815,568 | 3/1989 | Bittar | 187/127 |
| 4,838,384 | 6/1989 | Thangavelu | 187/125 |
| 4,947,965 | 8/1990 | Kuzunuki et al. | 187/127 |
| 5,022,497 | 6/1991 | Thangavelu | 187/124 |
| 5,024,295 | 6/1991 | Thangavelu | 187/125 |
| 5,035,302 | 7/1991 | Thangavelu | 187/125 |
| 5,053,640 | 1/1992 | Tsuji | 187/127 |
| 5,146,053 | 9/1992 | Powell et al. | 187/127 |
| 5,168,136 | 12/1992 | Thangavelu et al. | 187/130 |
| 5,202,540 | 4/1993 | Auer et al. | 187/101 |

*Primary Examiner*—Steven L. Stephan
*Assistant Examiner*—Robert Nappi

[57] ABSTRACT

Assignment of elevators to hall calls is performed directly as a function of one or more system performance parameters, all related to passenger waiting time. Assignment of elevators to hall calls is performed directly as a function of one or more system performance parameters by calculating said function as an objective (meaning object or goal) function dependent upon those system performance parameters.

2 Claims, 10 Drawing Sheets

COMPARE RRT(B) TO RRT(C) TO EVALUATE THE MERIT OF CURRENT ASSIGNMENT AND TO EVALUATE IF A REASSIGNMENT TO ANOTHER CAR WOULD BE A GOOD IDEA

RRT (B | ▽9) = 6 SECS
RRT (C | ▽9) = 15 SECS

PRT (▽6 IF B IS ASSIGNED TO ▽9) = 65 SECS
PRT (▽6 IF C IS ASSIGNED TO ▽9) = 55 SECS

ELEVATOR DISPATCHING WITH MULTIPLE TERM OBJECTIVE FUNCTION AND INSTANTANEOUS ELEVATOR ASSIGNMENT

TECHNICAL FIELD

The present invention relates to assignment of elevators to hall calls.

BACKGROUND OF THE INVENTION

An elevator dispatcher causes a particular elevator in a bank of elevator cars to be sent to a floor in response to a user pressing a hall button at that floor. Traditionally, a hall lantern will illuminate just prior to the opening of the car doors in order to inform the user as to which car will service his hall call.

The dispatcher assigns a car to a hall call according to a variety of elevator system parameters. It is possible for values of these system parameters to change between the time the hall call is registered and the time the hall call is serviced. Therefore, the dispatcher may reassign the hall call to other cars many times before the hall call is serviced. The user does not notice the reassignment because the hall lantern is lit only after these multiple reassignments have occurred and just before the car arrives at the floor.

According to a dispatching scheme called instantaneous car assignment (ICA), once a car has been assigned to a hall call, the assignment may not be changed. Unlike traditional elevator assignment techniques, ICA informs the user at the instant of first assignment (or shortly thereafter) as to which car will service his/her hall call. The benefit is that the user can be walking toward that particular car, of the bank of cars, which is going to serve him and be positioned and ready to enter that car when it arrives. A know-and-go time is the time from when a passenger knows which car is responding to his hall call to the time it takes him to go over to the car. Therefore, giving the user the opportunity to be in front of the car when it arrives requires that numerous reassignments of a hall call to different cars cannot take place. To the extent a dispatcher is spending time reassigning, the know-and-go time is used up.

The reason for allowing multiple reassignments in the past was to obtain the best assignment; concern over an initial optimum assignment was minimized in the past because there would always be reassignments possible and therefore the opportunity to correct for an initial assignment that had become less than optimum in light of subsequent events such as new hall calls and car calls. Under ICA, however, because there is little or no time for reassignments, the importance of a good initial assignment is increased.

The first uses of ICA were not as sensitive to this issue as they might have been. Relative System Response (RSR), taught in U.S. Pat. No. 4,363,381 "Relative System Response Elevator Call Assignments", is one scheme typically used with the expectation that multiple reassignments would be allowed. ICA was used in conjunction with RSR. This RSR/ICA scheme, therefore, fixed the first car to hall call assignment using RSR—a scheme for which the initial assignment did not account for future events (new hall calls and car calls) which would serve to degrade the quality of an initial assignment. The need for a better initial assignment remained after RSR/ICA.

The average registration is the time from when the hall call button is pressed to the time that the hall call is cancelled. This latter point in time varies with different elevator systems—for some, the hall call is cancelled when the car arrives at the floor and is leveling while for others the hall call is cancelled at a stop control point typically located where deceleration of the elevator begins as it nears the floor begins and a hall lantern is lit. Note that registration time is not equal to waiting time because not all passengers wait the same time and therefore we cannot easily measure the waiting time of all passengers.

The average registration time of an elevator system is a common metric for the performance of that system. However, a good average registration time can be deceptive, hiding an occasional, extremely long registration time among numerous, very short registration times. Engineers have discovered that there will usually be one hall call during a heavy two-way traffic scenario which waits a very long time (for example, 135 seconds). These long waits occur rather infrequently (for example, once or twice in one thousand hall calls). It has been observed that the associated hall calls have often been bypassed by at least one (usually several) car. These bypasses happen because the bypassing car was not the one assigned to the hall call at the time of the bypass. If the bypassing car had stopped for the hall call, then the very long registration time could have been reduced.

Customers have pointed out the need to reduce these very long registration times. By reducing the number of hall call bypasses, a dispatcher may reduce the longest registration time. At the same time, however, the average of all registration times may increase because special treatment to a long-waiting call is given at the expense of several other hall calls. In some markets, it is understood that the market place will accept a higher average registration time in favor of a lower maximum registration time.

FIG. 1 illustrates this maximum registration time dilemma and the failure of the prior art to address it. According to the prior art, car B is assigned a hall call at floor 7 while car B is heading in the down direction when a new hall call at floor 9 is registered, which hall call is as yet not assigned. Car A is also heading in the down direction but is farther from the hall call registered at floor 9 than car B. According to the prior art RSR scheme, car B will more than likely be assigned to the hall call at floor 9 because car B is closer than car A to floor 9. This is optimum for the person who registered the hall call at floor 9, but the person who registered the hall call at floor 7, to which car B is already committed, had been waiting for sixty seconds for a car already when the hall call at floor 9 was registered. The person at floor 9 has a very short wait, but the person at floor 7 who has already waited a long time, now waits even longer.

Disclosure of the Invention

Objectives of the present invention include reducing the maximum registration time, while maximizing the know-and-go time and still achieving a good initial elevator assignment.

According to the present invention, assignment of cars to hall calls is performed directly as a function of system performance parameters, related to passenger waiting time including 1) remaining response time (RRT), and one or more of: 2) predicted registration time (PRT), 3) maximum predicted registration time (maxPRT) and 4) a relative system response (RSR) quantity. In still further accordance with the present invention, the assignment of elevators to hall calls is performed according to the system parameters and reassignment is discouraged to incorporate an instantaneous elevator assignment feature.

An advantage is that the waiting time of long-waiting calls is reduced.

BEST MODE FOR CARRYING OUT THE INVENTION

The dispatching method of the present invention consists of two parts. First, for a new hall call, a car is assigned to the call by choosing the car which provides the minimum value of the objective (meaning goal) function:

$$\text{OBJ (icar)} = A \cdot RRT + B \cdot |PRT - 20| + \delta \cdot C \cdot (maxPRT - 60) + D \cdot RSR.$$

Each term is discussed in detail below.

Objective functions used in elevator dispatching are not new, see U.S. Pat. No. 4,947,965 Kuzunuki et al, "Group Control Method and Apparatus for an Elevator System with Plural Cages". The RSR algorithm uses an objective function. The RSR algorithm and various modifications of it can be said to include various terms, depending on the RSR algorithm employed. The basic component of the RSR quantity is an estimate of the number of seconds a elevator would require to reach a hall call.

However, the use of the particular objective function, the selection of the elements of the object function, the use of an objective function in combination with ICA and the assignment of cars to hall calls directly as a function of elevator system performance metrics are, among other things presented here, new.

The second part of the invention is the instantaneous car assignment (ICA) feature in combination with the objective function. For a hall call that has been waiting for some time with a car already assigned, switching the assignment to another car is unlikely according to the present invention. Under no circumstances will more than one reassignment be allowed. A switch, that is a reassignment, is permissible under two exceptional circumstances: 1) there is a car other than the assigned one that can reach the call significantly faster (for example, by at least 40 seconds) and 2) the assigned car is traveling away from the call (for example, the car assigned to an up hall call is traveling upwardly above the call). In the case where a switch is permissible, the assignment is made based on the objective function. The values of the coefficients A, B, C, and D can be varied to reflect the preference of the building owner. It is also clear that by setting all but one coefficient to zero, dispatching assignments can be made based on a single metric.

RRT (remaining response time)

The term remaining response time is fully described in U.S. Pat. No. 5,146,053 entitled "Elevator Dispatching Based on Remaining Response Time", issued to the same inventors as the present invention. It is an estimate of the number of seconds an elevator would require to reach the hall call under consideration given its current set of assigned car calls and hall calls. It is sometimes referred to in the elevator industry as estimated time of arrival (ETA).

Figure 1:
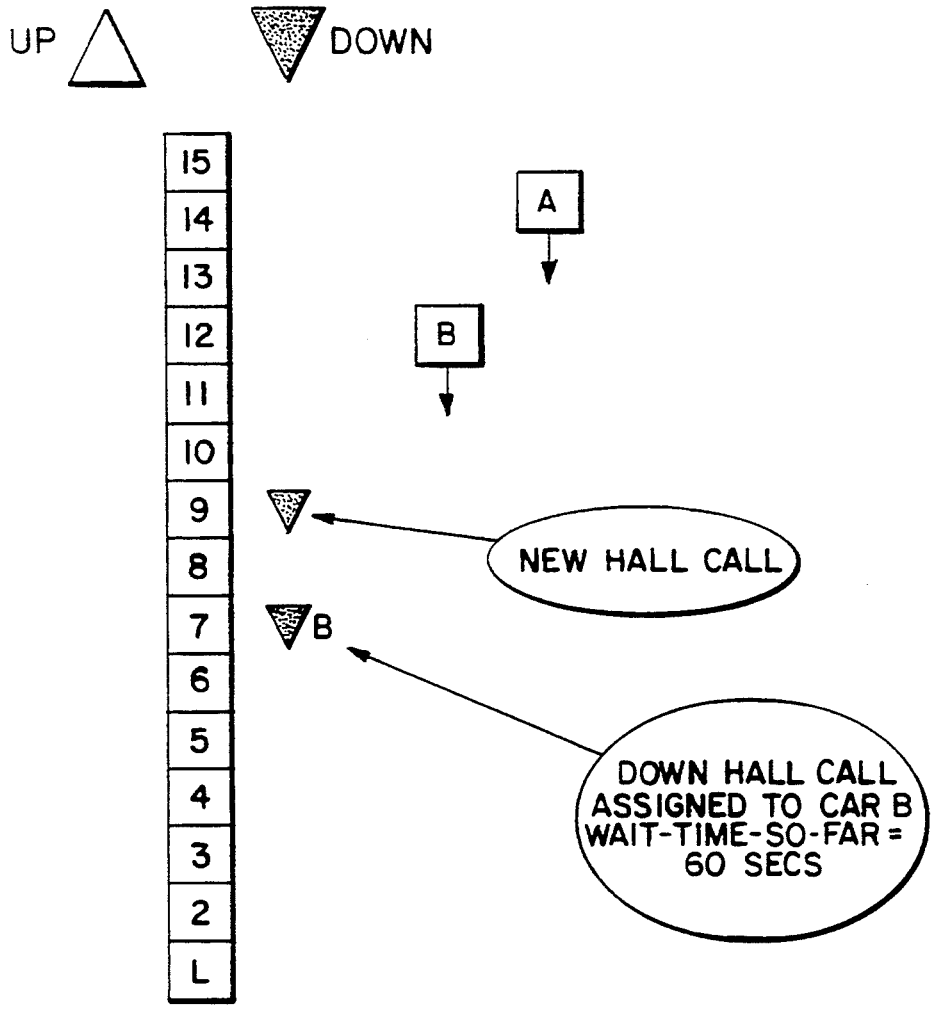
FIG. 1 PRIOR ART
FIG. 1 is a prior art chart of floors mapped against the location of cars in a bank of elevators and registered hall calls.
Figure 2B:
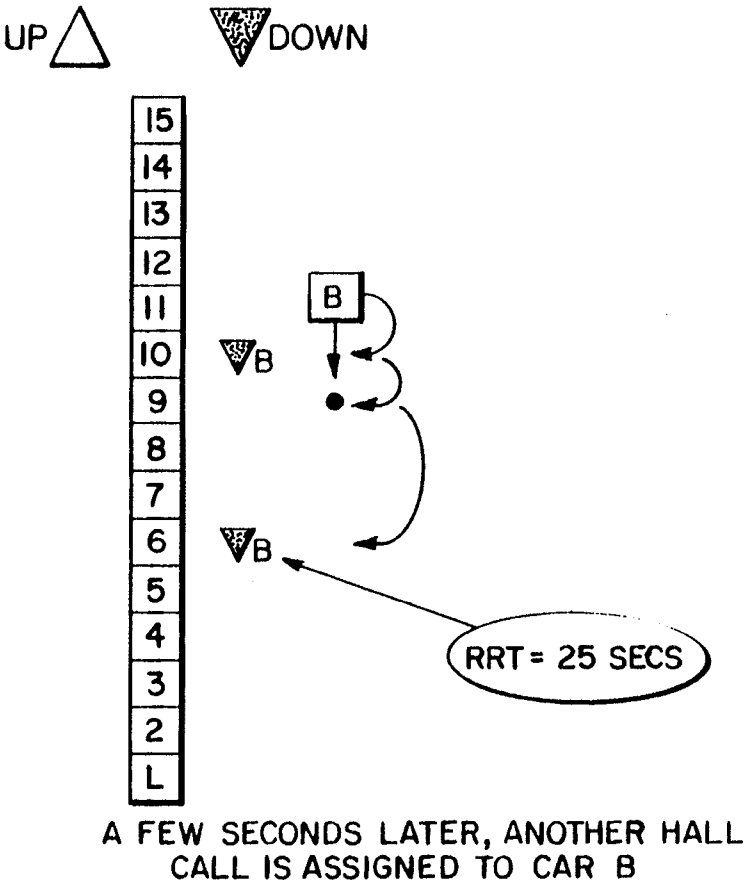
FIG. 2 maps floors against the location of a car B and car calls and hall calls for assignment to car B.
Figure 2A:
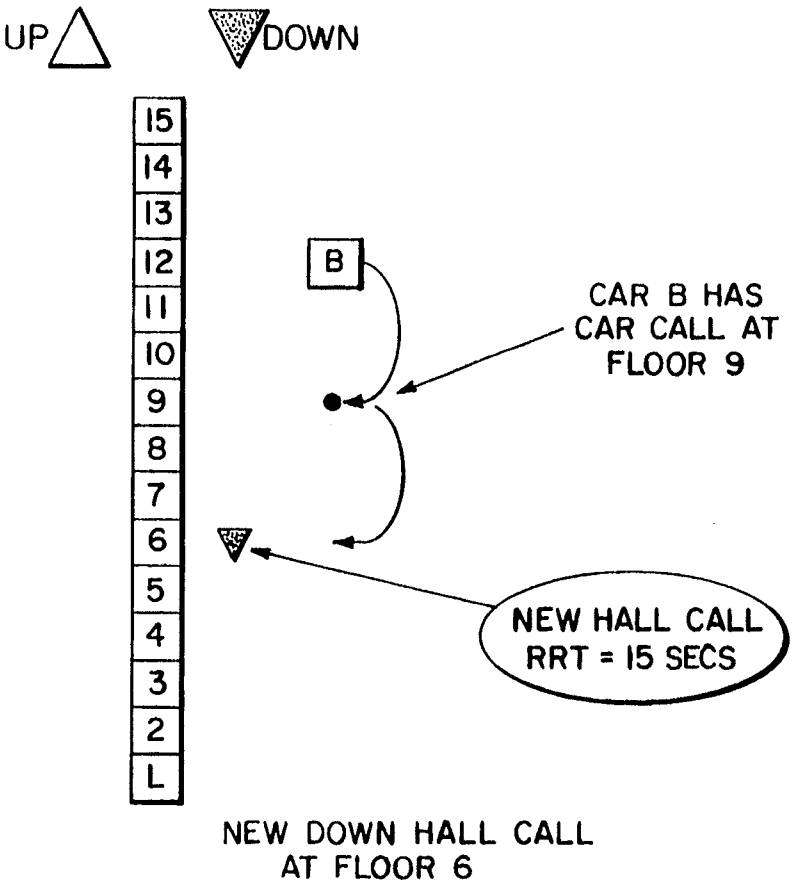

FIG. 2 illustrates a car B moving in the down direction and positioned at floor 12 on its way to service a car call at floor 9. At this point, a new hall call is registered at floor 6. The remaining response time for the new hall call for car B is an exemplary 15 seconds. A few seconds later, another hall call is assigned when the car B, still moving downwardly in the direction of its car call at floor 9 and assigned hall call at floor 6, when another hall call is assigned to it at floor 10. The additional hall call at floor 10 increases the remaining response time of the call at floor 6 to 25 seconds from 15 seconds.

Figure 3:
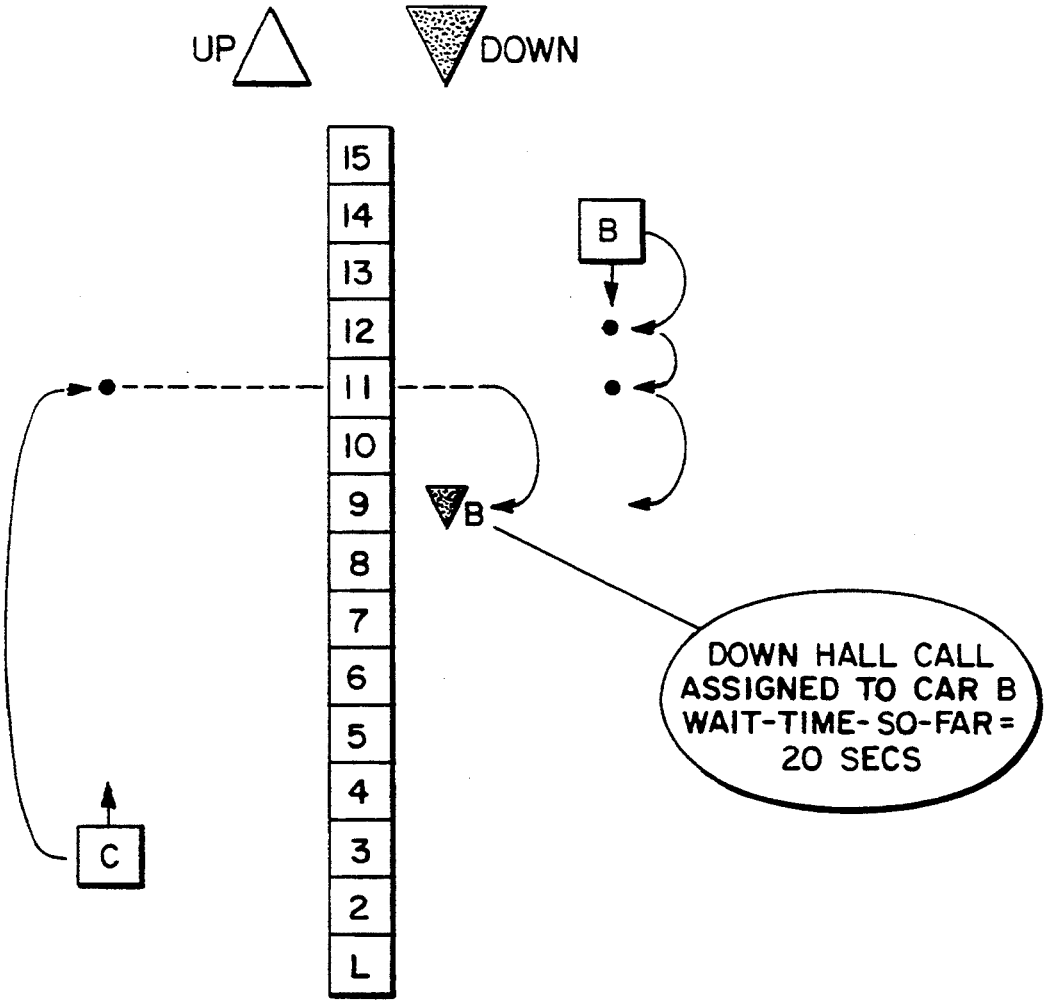
FIG. 3 is a mapping of floors against the location of cars B, C and elevator calls associated with those elevators and a hall call associated with car B.

FIG. 3 maps floors in a building against car calls for cars B and C and a hall call assigned to car B. FIG. 3 illustrates the remaining response time concept after a hall call has already been waiting an exemplary time of 20 seconds. In FIG. 3 a car B is traveling in the downward direction to service two car calls before servicing a hall call assigned to car B where the passenger has already been waiting for 20 seconds. Meanwhile, a car C is moving in the upward direction to service a car call at a floor above the location of the hall call. The question arises as to whether the hall call should remain assigned to car B or be reassigned to car C.

Where the assignment of cars to hall calls is based purely on remaining response time, the remaining response time for assignment to car B is compared to the remaining response time for car C to evaluate the merit of the current assignment and determine whether a switch, that is a reassignment, from car B to car C would be a good idea.

Also, if the trip to reach a hall call in the opposite direction includes an assigned hall call in the direction of travel, then for the purposes of remaining response time computation the car is assumed to go to the terminal floor. (For example, consider a car traveling up at floor five with a car call at 7 and an assigned hall call at floor 9. Now, a down call is registered at floor 10. To estimate the remaining response time of the car, the car is assumed to be sent to the top terminal to fulfill the car call resulting from the hall call at floor 9 before it can reach floor 10 in the down direction). Upon reflection, it can be seen that this assumption that the cars go to the terminal floor is not necessarily the worst case.

We assume that only one car call results from the up hall call at floor 9, and that is to the terminal floor (the top). A much worse situation would be if several people were waiting behind the hall call at floor 9, and each pressed a different car call button. For this worse case, the RRT would obviously be much longer, due to additional stops.

PRT (predicted registration time)

Figure 4:
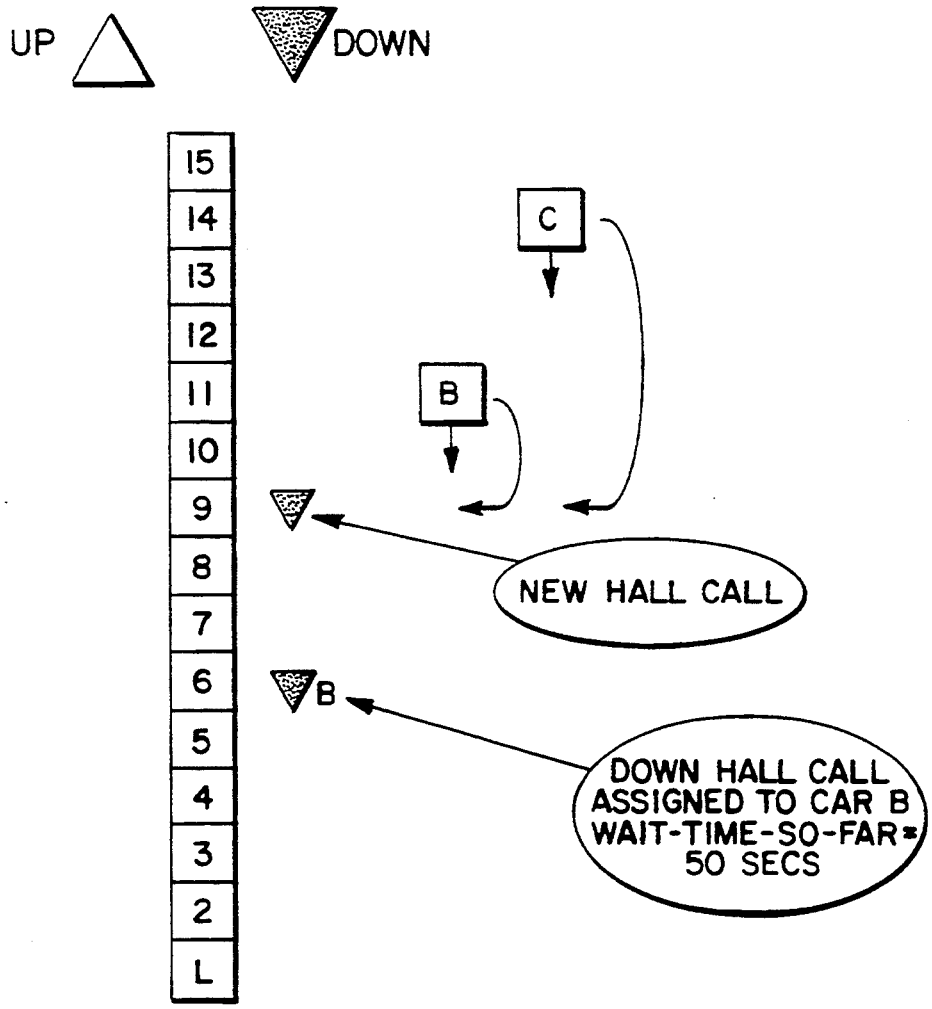
FIG. 4 is a map of floors against registered hall calls, and the location of car B, C.

This metric is the sum of the amount of the time that the call has already been waiting (the wait time-so-far) and the RRT. For a new hall call, PRT=RRT. FIG. 4 illustrates why assignment of hall calls based solely on remaining response time is not sufficient for good hall call assignments and why predicted registration time is important. Car B is presently at floor 11, car B is moving downwardly to service a hall call assigned to it at floor 6 where the passenger's wait time-so-far is (a very long) 50 seconds when a new hall call is registered at floor 9. Another car C at floor 14 is also moving downwardly. The remaining response time of car B for the new hall call at floor 9 is six seconds. The remaining response time of the car C with respect to the new hall call at floor 9 is 15 seconds, because the car C is farther away from the new hall than car B. It would seem at this point that the logical selection for the assignment for the hall call is car B. Under certain circumstances, this assignment would not be appropriate, however, because of the effect of that assignment on other calls. The predicted registration time for the call at floor six if car B is assigned to the hall call at floor 9 is increased to 65 seconds. The predicted registration time for the call at floor 6 if car B is assigned to the hall call at floor 9 is 55 seconds. Thus, assigning the car B to the new hall call at floor 9 based on the shortest remaining response time comparison for the two cars results in a very long predicted registration time for the passenger at floor 6. The predicted registration time results where an assignment is made purely as a function of the remaining response time metric is poignant where as an extra 10 seconds of waiting for the passenger at floor 6 is the difference between an anxious passenger and a furious passenger, as a consequence of the nonlinearity of passenger frustration as a function of waiting time.

Hence, the wisdom of including the predicted registration time in the objective function.

The predicted registration time metric is included in the objective function as the absolute value of the difference between the predicted registration time and the term, $T_1$, of 20 seconds. If the predicted registration time is either very short or very long, then the term, $T_1$, penalizes a car. This reflects the philosophy in some markets that a passenger is willing to wait approximately 20 seconds without any level of discomfort. Of course, this penalty term is variable and need not be 20 seconds. Therefore, a car that could reach the hall call in a very short time (for example, five seconds) might better proceed to answer other more urgent elevator system demands.

maxPRT (maximum predicted registration time)

Waiting times in excess of 90 seconds are considered very long while their frequency is low (once or twice in a two hour heavy two-way traffic). Their effect is a major irritant to passengers. It is important to reduce the magnitude and frequency of these long-waiting calls. The present invention proposes to address these long calls by penalizing the car for an assignment only when that assignment will cause the longest waiting call (of all hall calls presently waiting) to wait longer than a term, $T_2$, 60 seconds. It is thought that a call that has already waited 60 seconds has a potential to cross the 90 seconds threshold and therefore should be given special consideration. The penalty term is variable and need not be 60 seconds. The term is squared in the objective function to reflect the passengers growing irritation which is felt to be nonlinear and increasing as the waiting time increases beyond 60 seconds. Obviously, the term maxPRT, like PRT, need not be squared but could be the argument for any other function to model passenger irritation. The Dirac Delta operator ensures that the third term is zero where maxPRT is not longer than 60 seconds.

RSR (relative system response)

This metric is used currently in the objective function in order to allow the building owner to revert to the prior art RSR dispatching methodology.

The value of the RSR term selected depends upon which form of RSR is desired, as it has many modifications. The basic component of the RSR quantity is the estimated amount of time for a car to reach the hall call whose assignment is being determined. The value selected, however, for the RSR value may be any of those shown in U.S. Pat. No. 5,146,053 issued to Powell et al entitled Elevator Dispatching Based on Remaining Response Time; U.S. Pat. No. 4,363,381 issued to Bittar, entitled Relative System Response Elevator Call Assignments; U.S. Pat. No. 4,815,568 to Bittar entitled Weighted Relative System Elevator Car Assignment System with Variable Bonuses and Penalties; U.S. Pat. No. 4,782,921 to MacDonald et al. entitled Coincident Call Optimization in an Elevator Dispatching System; U.S. Pat. No. 5,202,540 issued to Auer entitled Two-way Ring Communication System for Elevator Group Control; U.S. Pat. No. 5,168,136 issued to Thangavelu et al entitled Learning Methodology for Improving Traffic Prediction Accuracy of Elevator System Using Artificial Intelligence; U.S. Pat. No. 5,035,302 issued to Thangavelu entitled Artificial Intelligence based Learning System Predicting Peak-Period Times for Elevator Dispatching; U.S. Pat. No. 5,024,295 issued to Thangavelu entitled Relative System Response Elevator Dispatcher System Using Artificial Intelligence to Vary Bonuses and Penalties; U.S. Pat. No. 5,022,497 issued to Thangavelu entitled Artificial Intelligence Based Crowd Sensing System for Elevator Car Assignment; and U.S. Pat. No. 4,838,384 issued to Thangavelu entitled Queue Based Elevator Dispatching System Using Peak Period Traffic Prediction, incorporated by reference. The bonuses and penalties making up the RSR term can be varied or fixed.

Figure 5A:
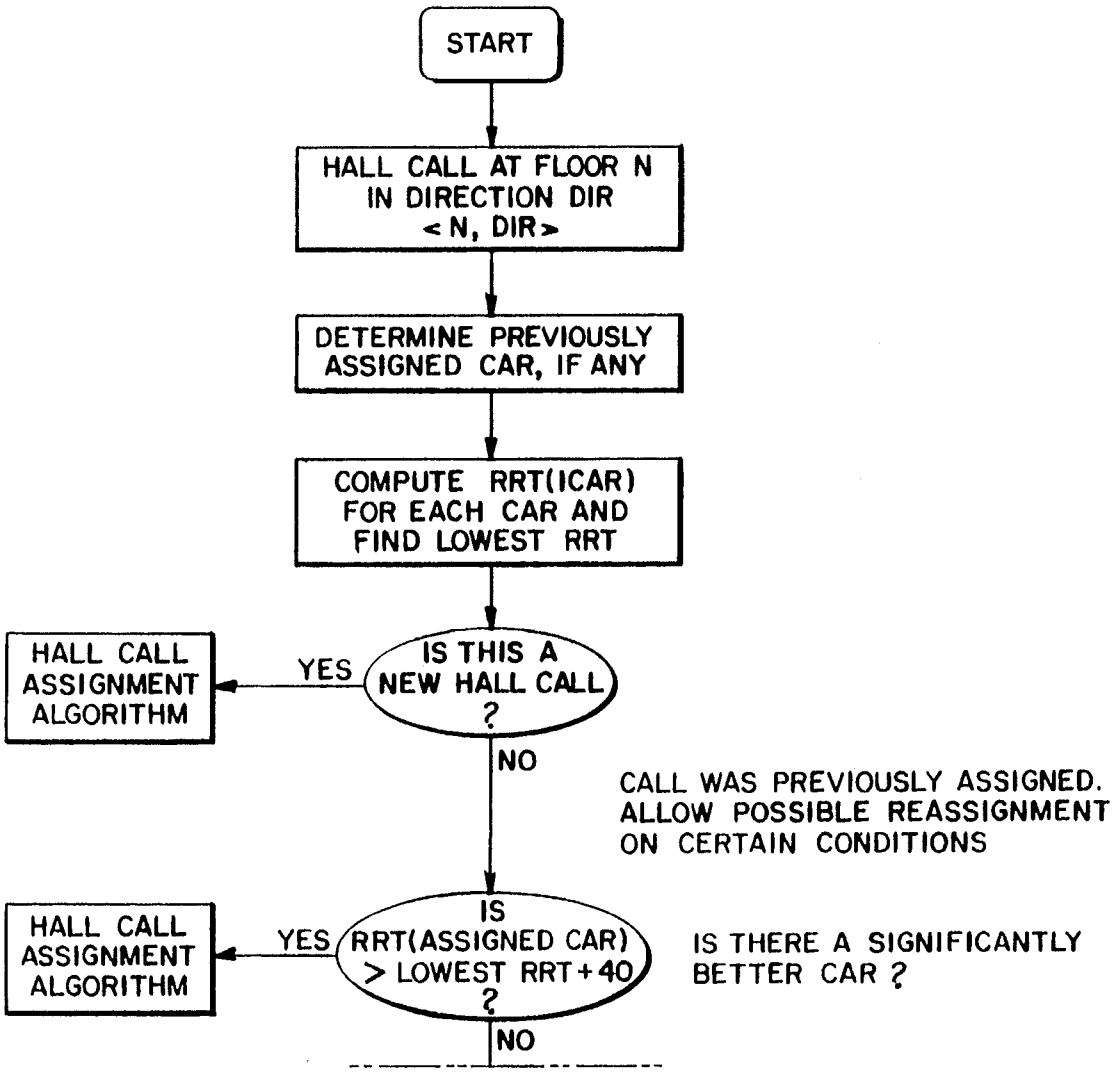
FIG. 5 is a master flow chart for illustrating the method of the present invention.
Figure 5B:
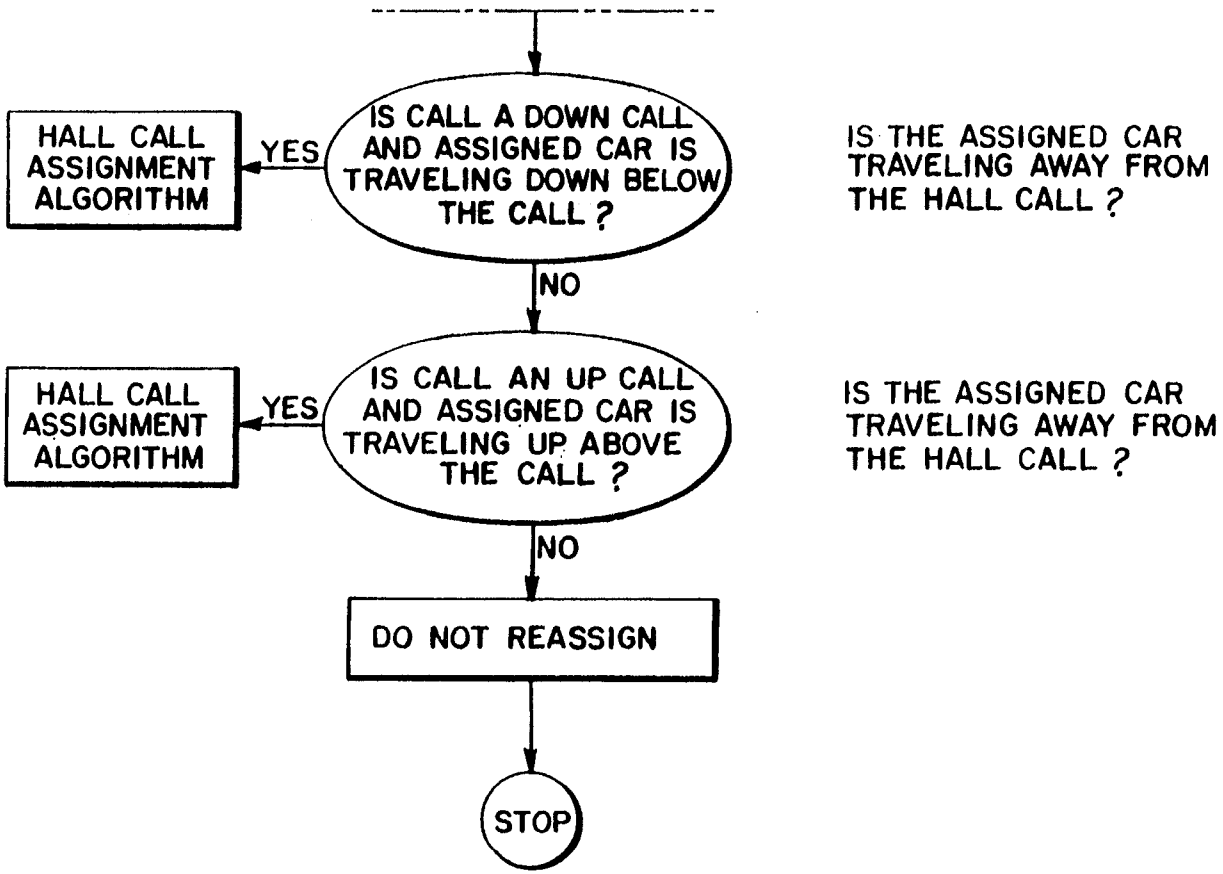

FIG. 5 is a master flow chart for implementing the method of the present invention. After a start, a hall call at a floor N in a given direction is registered. Then, an elevator dispatcher determines if the hall call was previously assigned to a car and records the car of the assignment. Next, the remaining response time is calculated for each car in the bank and the lowest remaining response time and the car associated with it is determined.

A series of tests is now executed to determine if a hall call assignment algorithm (FIG. 6) for reassigning the call should be executed. The routines of FIGS. 5, 6 and 7 incorporate the basic concept of instantaneous car assignment in that the call is not reassigned unless there are strong incentives for doing so; even then, no more than one reassignment is allowed. The first test asks "Is this a new hall call?". If so, completion of the routine of FIG. 5 waits for execution of the hall call assignment algorithm illustrated in FIG. 6. If not, the next three tests may be executed for determining whether the previously assigned call should be reassigned. In test two, if the remaining response time of the assigned elevator is greater than the lowest remaining response time plus 40 seconds, execution of the routine at FIG. 5 waits until execution of the hall call assignment algorithm (FIG. 6) for possible reassignment of the hall call to another car. This test indicates that reassignment is strongly discouraged but if the remaining response time of the present car is extremely poor with respect to the lowest remaining response time then reassignment should be considered. Extremely poor is defined by a variable predicted registration time difference, here 40. The third and fourth tests stall execution of the routine of FIG. 5 until the hall call assignment algorithm is executed if the assigned car is traveling away from the assigned call. None of these tests being met in the affirmative, there is no reassignment.

Figure 6A:
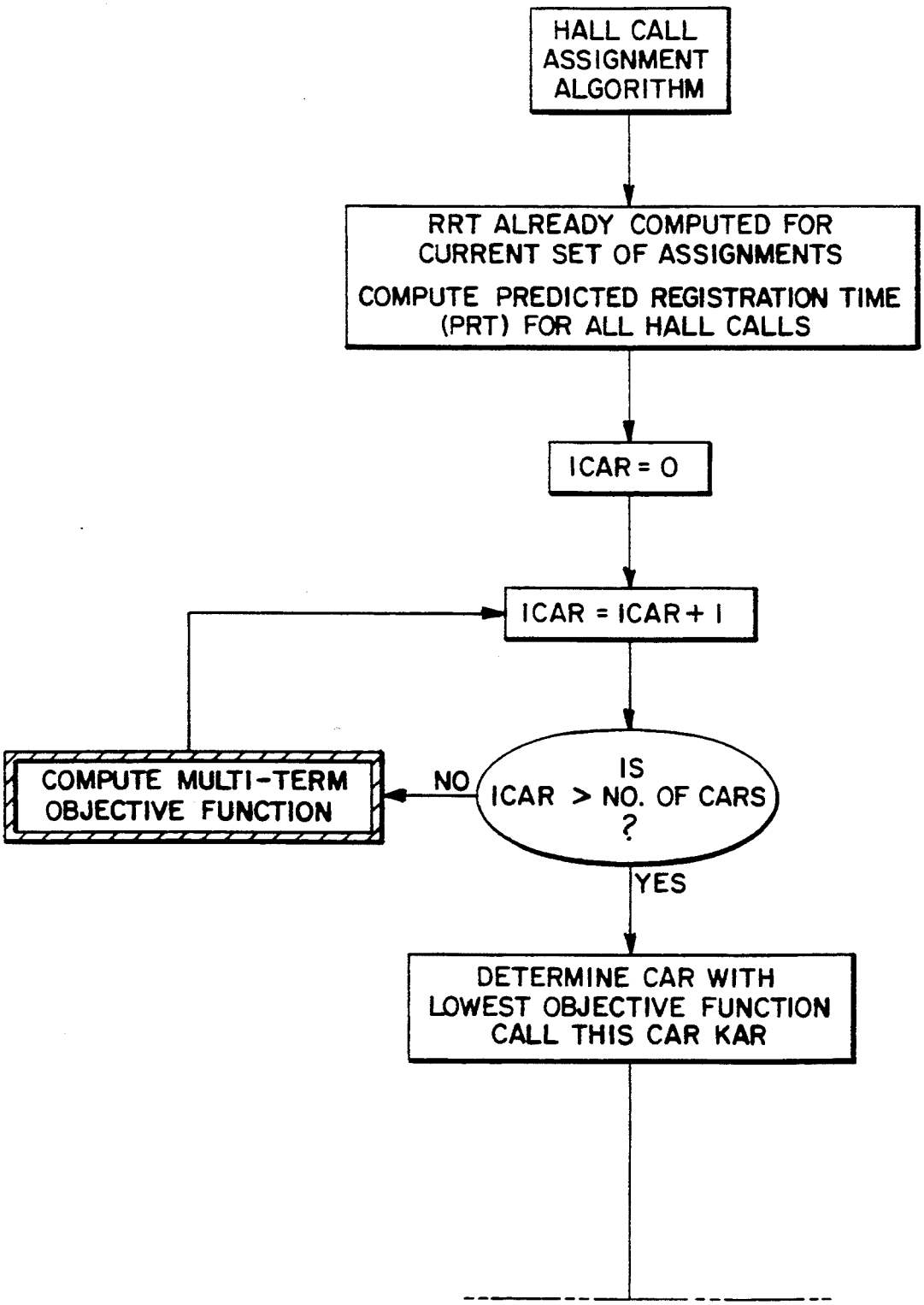
FIG. 6 is a flow chart of a hall call assignment algorithm.
Figure 6B:
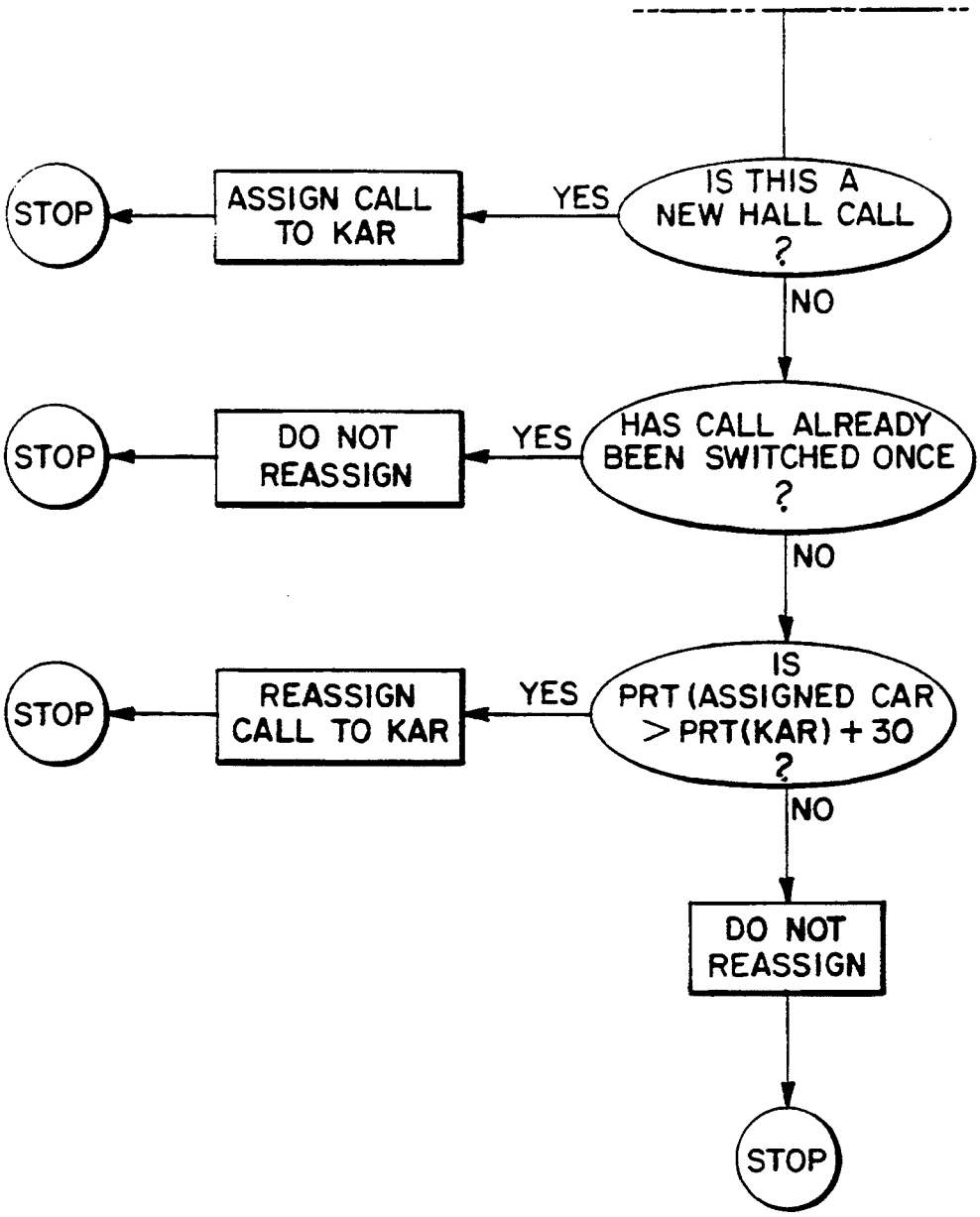

FIG. 6 illustrates the hall call assignment algorithm. First, the remaining response time already computed for the current set of assignments of hall calls to cars is read and used for computing the predicted registration time (PRT) for all hall calls, by adding the wait time-so-far for each call to the associated remaining response time. Next, a car index icar is set to zero. The index is incremented by one for each car in the bank, and a multi-term objective function is computed for that car, until all cars have been considered. Next, the car with the lowest objective function is determined and given a label KAR.

A series of tests is then executed for determining whether there should be a reassignment. These three tests are similar to the four tests of FIG. 5 insofar as their execution infrequently results in reassignment of a call out of deference to instantaneous car assignment. In the first test, if the hall call is a new one, then the hall call is assigned. If the hall call is not a new call (test two) and the call has already been switched once from the car of first assignment, then the hall call is not reassigned. If the call is not a new one, then the predicted registration time (PRT) of the assigned car is compared with the predicted registration time (PRT) of the car, "KAR" with the lowest objective function If the predicted registration time (PRT) of the assigned car is far greater than the predicted registration time of the elevator with the lowest objective function, then the hall call is reassigned to the elevator car (KAR) with the lowest objective function, but otherwise, no reassignment occurs.

Figure 7:
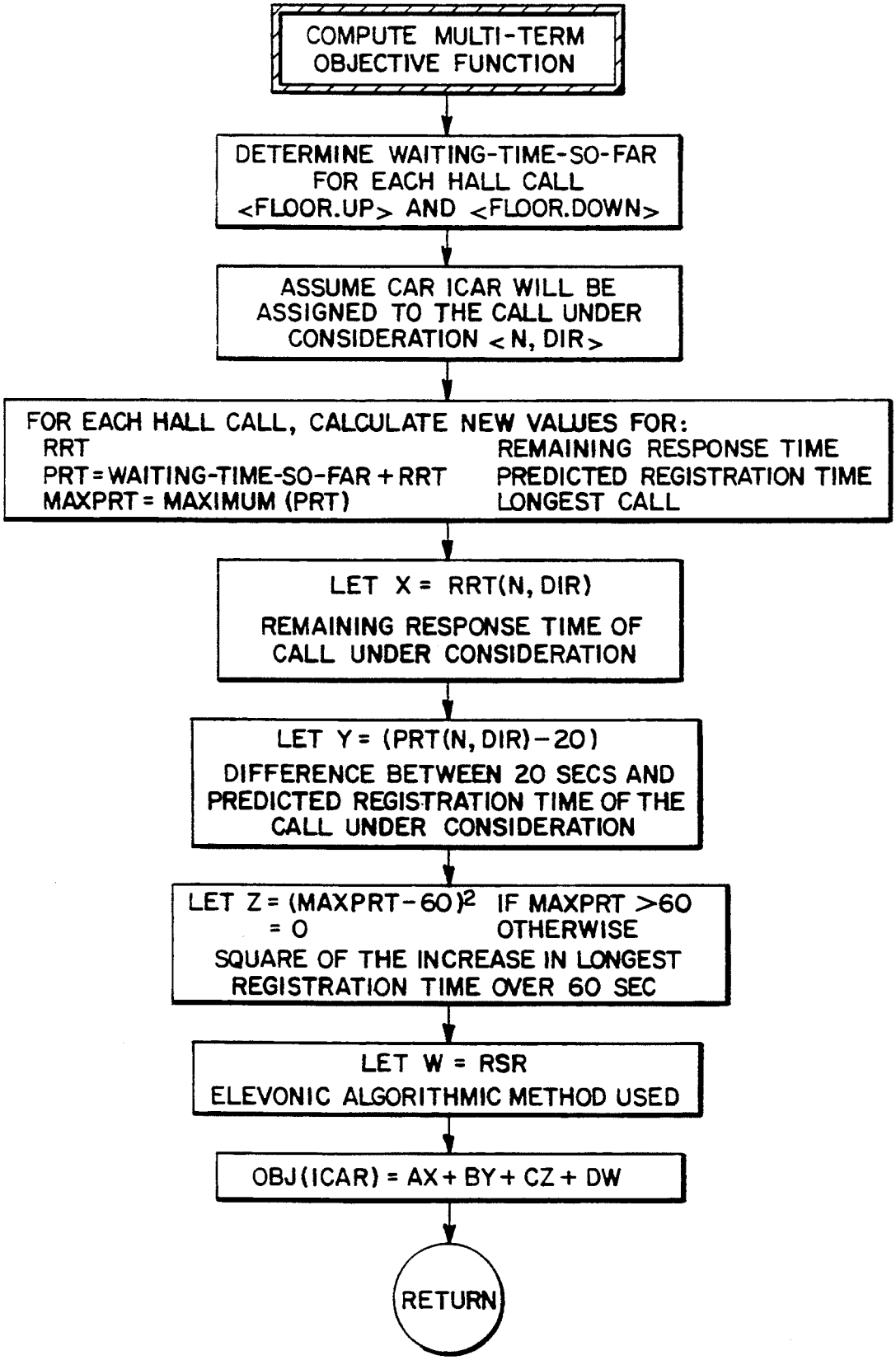
FIG. 7 is a flow chart for determining an objective function.

FIG. 7 illustrates calculation of the multi-term objective function. First, the wait time-so-far for each hall call is stored and mapped against the direction of that hall call. Next, the car for which the objective function is being calculated is assumed to be assigned to the call being considered for reassignment in the master flow chart routine. Third, the remaining response time (RRT), predicted registration time (PRT), maximum predicted registration time (maxPRT), and the RSR value are calculated. The values for the four terms of the multi-term objective function are now calculated and summed for producing the multi-term objective function for use in the assignment algorithm hall call.

Figure 8:
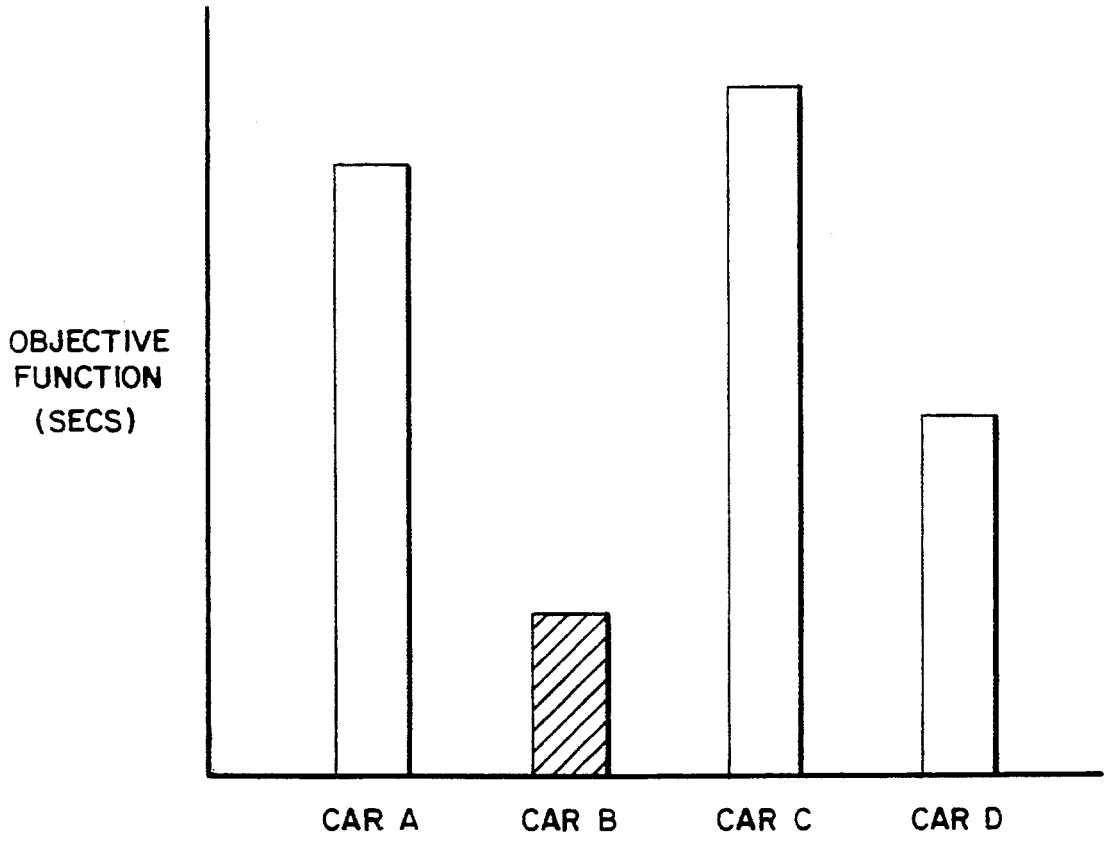
FIG. 8 is a graphical representation of an objective function with a single independent variable, showing the existence of a minimum value for the objective function.

FIG. 8 is a graph of the objective function of the cars in a bank; the car with the minimum value of the objective function (car B) is assigned to a hall call.

Various changes may be made without departing from the spirit and scope of the invention.

We claim:

1. In an elevator system having a plurality of elevator cars, an elevator dispatcher for assigning elevator cars to hall calls, and a plurality of hall calls, a method for assigning an elevator car to service a new hall call, the method comprising the steps of:

registering a new hall call;

for each elevator car of the plurality:

estimating a remaining response time value to respond to the new hall call, estimating a predicted registration time value to respond to the new hall call, estimating a maximum predicted registration time value to respond to all previously assigned hall calls;

estimating a relative system response factor value for the elevator system;

estimating an objective factor value according to the relation $$OBJ = (A \cdot RRT) + (B \cdot |PRT - T_1|) + (\delta \cdot C^2) + (D \cdot RSR)$$

where OBJ = the objective factor value for an elevator car,

A, B, C and D are coefficients, the value of which may be varied,

RRT = remaining response time value for the car,

PRT = predicted registration time value for the car, maxPRT = maximum predicted registration time value, $T_1$ = a first time value threshold, $T_2$ = a second time value threshold, RSR = relative system response factor value, and wherein $\delta = 1$ if maxPRT is greater than $T_2$ and 0 if less than or equal to $T_2$;

comparing the objective factor value of each of the elevator cars to identify an elevator car having the smallest objective factor value;

assigning the identified elevator car to respond to the new hall call; and moving the assigned elevator car to the new hall call.

2. In an elevator system having a plurality of elevator cars, an elevator dispatcher for assigning elevator cars to hall calls, and a plurality of hall calls, a method for reassigning an elevator car to service an existing hall call, the method comprising the steps of:

for each elevator car of the plurality:

estimating a remaining response time value to respond to the existing hall call, estimating a predicted registration time value to respond to the existing hall call, estimating a maximum predicted registration time to respond to all previously assigned hall calls;

estimating a relative system response factor value for the elevator system; and estimating an objective factor value according to the relation $$OBJ = (A \cdot RRT) + (B|PRT - T_1|) + (\delta \cdot C^2) + (D \cdot RSR)$$

where OBJ = the objective factor value for an elevator car,

A, B, C and D are coefficients, the value of which may be varied,.

RRT = remaining response time value for the car,

PRT = predicted registration time value for the car, maxPRT = maximum predicted registration time value, $T_1$ = a first time value threshold, $T_2$ = a second time value threshold, RSR = relative system response factor value, and wherein $\delta = 1$ if maxPRT is greater than $T_2$ and 0 if less than or equal to $T_2$;

comparing the objective factor value of each of the elevator cars to identify an elevator car having the lowest objective factor value;

assigning the identified elevator car to respond to the existing hall call; and moving the assigned elevator car to the existing hall call.

* * * * *